US005339291A

United States Patent [19]

Libuha et al.

[11] Patent Number: 5,339,291

[45] Date of Patent: Aug. 16, 1994

[54] FLEXIBLE COMPONENT SHEET EMBEDDING OPERATIONAL COMPONENTS

[75] Inventors: John J. Libuha, Old Lyme; William F. Wardle, Mystic, both of Conn.

[73] Assignee: The United States of America as represented by the Secretary of the Navy, Washington, D.C.

[21] Appl. No.: 826,055

[22] Filed: May 7, 1969

[51] Int. Cl.[5] ..... H04R 17/00

[52] U.S. Cl. ..... 367/165; 367/153

[58] Field of Search ..... 340/8, 8 S, 5 A, 10; 367/188, 165, 157, 154, 153, 152

[56] References Cited

U.S. PATENT DOCUMENTS

| | | | |
|---|---|---|---|
| 2,649,579 | 8/1953 | Alexander | 367/169 |
| 2,807,793 | 9/1957 | Bayhi | 367/154 |
| 3,113,287 | 12/1963 | Renner | 367/165 |
| 3,130,700 | 4/1964 | Peterson | 367/1 |
| 3,212,056 | 10/1965 | Grieg | 367/157 |
| 3,360,772 | 12/1967 | Massa | 367/188 |

*Primary Examiner*—Daniel T. Pihulic

*Attorney, Agent, or Firm*—Michael J. McGowan; Prithvi C. Lall; Michael F. Oglo

[57] ABSTRACT

A flexible sheet in which miniaturized operational components, such as hydrophones, solid-state preamplifiers and wires, can be embedded or molded into a flexible carrier. The sheet can also be built up of layers, such as an acoustic isolation layer. The sheet is affixed to a mounting surface by adhesives or otherwise and assumes the shape of the mounting surface so that conformal transducer arrays, for example, are easily formed.

3 Claims, 2 Drawing Sheets

FLEXIBLE COMPONENT SHEET EMBEDDING OPERATIONAL COMPONENTS

The invention described herein may be manufactured and used by or for the Government of the United States of America for governmental purposes without the payment of any royalties thereon or therefor.

This invention relates to flexible component tapes, or sheets in which operational components such as electro-acoustic transducers and electronic preamplifiers, for example, are embedded.

The word "sheet" herein is used only to indicate a relatively thin object. It is not intended to convey the impression that the object is rectangular or necessarily covers a wide expanse, since the flexible sheet according to this invention may be formed in any shape, circular, square, rectangular, as a long, narrow, strip or tape, etc.

Conventional types of sonar transducer arrays, are installed in recesses in a ship's hull or superstructure or in a dome on a rigid frame or backing which is affixed to a ship's hull. These methods of installation cause serious disturbances in the hull plates or frames and add a great deal of undesired bulk.

An object of the invention is therefore to permit a transducer array to be installed on a surface such as a ship's hull without disturbance to the surface.

Another object is to provide conformal transducer arrays having very little bulk and capable of being installed with little change of the surface on which it is mounted.

Another problem with conventional methods of installation of sonar transducer arrays is that the necessary frames, recessed holes and other special alterations makes it difficult to design high acoustic impedance into the array. This deteriorates end-fire response.

A further object is to minimize the necessity for frames, recessed holes and other special alterations of the mounting surface when mounting a transducer array on a surface such as a ship's hull. By utilizing the present invention, it becomes easier to design a desired acoustic impedance into the array, such as a relatively uniform acoustic impedance across the array.

The conventional methods of mounting transducer arrays cause the array to be subject to mechanical damage due to explosions and other sources. Conventional methods may create structural discontinuities which result in stress concentrations. Problems also arise because of the sensitivity of transducer elements to mechanical vibrations.

Thus, an additional object is to make the transducer array more resistant to mechanical vibrations and sudden shocks.

The objects and advantages of the present invention are accomplished by molding miniaturized operational components together with their associated wiring into lapes or sheets -which are then attached flatly to a mounting surface such as a hull so that there is a minimal disturbance in the shape of the mounting surface.

Other objects, advantages and novel features of the invention will become apparent from the following detailed description of the invention when considered in conjunction with the accompanying drawings wherein.

Figure 1:
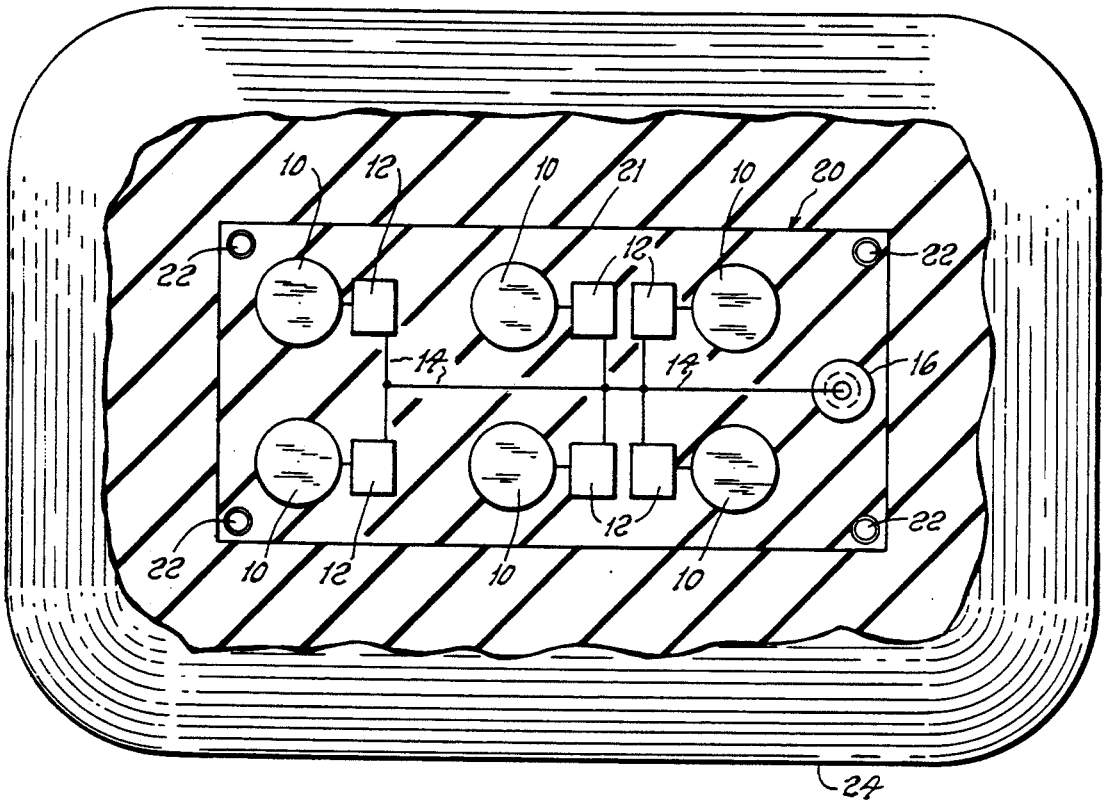
FIG. 1 is a top view of a typical embodiment of the invention utilizing a single sheet.

FIG. 1 shows a flexible, pliable component sheet, or tape, 20 comprising electrical components 10, 12 and 14 and flexible carrier 21 in the form of a feet-angular sheet. The particular form of the flexible sheet may be varied as desired; it may, for example, be a long ribbon or a circle. The carrier 21 is shaped around the electrical components.

The terms "flexible" and "pliable" are defined herein as meaning "easily bent or shaped."

The term "component sheet" is intended to mean a sheet in which operational components, as defined herein, are enclosed or embedded.

The sheet 20 contains, in this embodiment, an array of six transducers 10, which may, for example, be miniature hydrophones. Associated with each transducer 10 is a miniaturized, solid-state preamplifier 12 the output leads 14 of which pass through a watertight electrical fitting 16. The fitting 16 is inserted in the mounting surface 18 for the tape or sheet 20. The flexible sheet 20 is fastened to the mounting surface 18 (which may, for example, be the hull of a ship) by stud fasteners 22, or by adhesive bonding, if desired.

Figure 2:
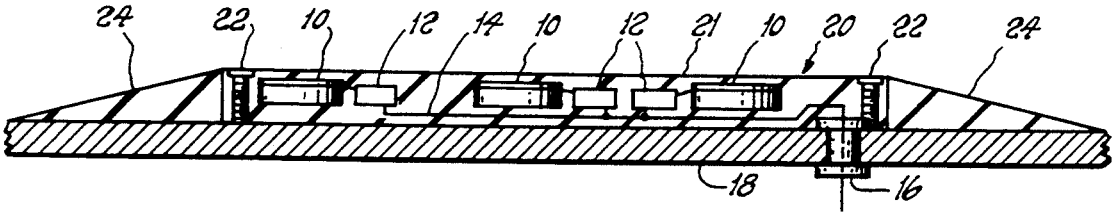
FIG. 2 is a cross-sectional, schematic view of the embodiment of the invention shown in FIG. 1.

FIG. 2 shows how the electrical components are spaced within the sheet 20 and how the entire assembly comprises a thin layer surrounded by a faired section 24. The latter smoothes the edges of the protuberance caused by the sheet 20 and streamlines the assembly.

The carrier portion of the sheet 20 is fabricated from a flexible, or pliable, material which will take the shape of the surface on which it is mounted. Thus, if the surface is a curve such as the hull of a submarine, the transducer assembly assumes the curved shape automatically when the sheet is laid upon the curved surface. Another desirable characteristic for the carrier is impermeability to sea water if the sheet is to be employed in a marine environment. If the flexible sheet embeds sonar transducers, the carrier should have substantially the same acoustic properties as those of sea water so that the output of the hydrophones is not impeded or attenuated by the carrier material. A neoprene that can be employed is the neoprene rubber elastomer having the following formula:

| Substance | Parts |
|---|---|
| Neoprene GRT | 80 |
| Neoprene FM | 20 |
| Stearic Acid | 1 |
| Neozone A | 2 |
| Lead-dioxide | 15 |

The mixture is heated at 250° F. for two minutes and then allowed to cure at the same temperature for one hour.

Adhesives which can be used to bond this neoprene rubber to a metal surface include the N-57 cement of the Gates Rubber Company or the "Pliabond" glue made by the Goodyear Rubber Company.

The fairing section 24 should be formed from a material which does not interfere with the acoustic properties of the transducers and is bondable to the mounting surface. The same material as that given above for the carrier can be used.

The flexible sheet 20 may be built up of several individual layers with holes, grooves and slots formed in the layers to accommodate the transducers, preamplifiers, cables, connectors and fittings that may be required. The layers can be bonded together after the electrical components are properly placed.

There may, for example, be a layer of acoustic damping material which might consist of rubber loaded with powdered lead. A second layer might be a vibration damping layer which could be fabricated from the material used for the carrier 21. An anechoic layer might be used. Thus, various properties, such as attenuation, anechoic, acoustical and mechanical dampening, and turbulent flow reduction, could be designed into the flexible sheet. Many of these properties can also be designed directly into the carrier material.

Figure 3:
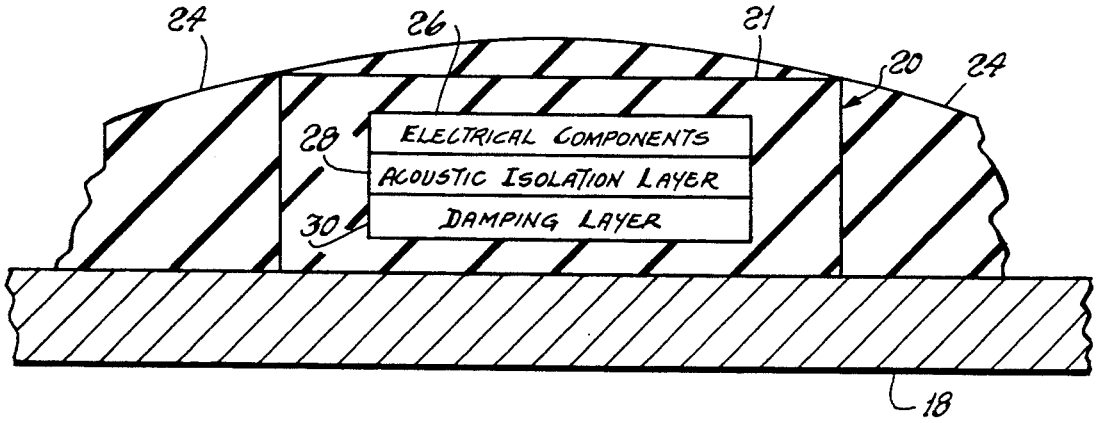
FIG. 3 is a cross-sectional schematic view of an embodiment of the invention in which an acoustic isolation layer and a damping layer are used.

FIG. 3 illustrates a multi-layer sheet in accordance with the concept of the invention. The carrier 21 encloses the electrical components 26, shown generally in this figure as a rectangle, an acoustic isolation layer 28 and a vibration damping layer 30. The acoustic isolation layer material may be a mixture of cork and rubber, for example, and the damping material may be a mixture of vinyl plastic and powdered lead, for example. A fairing section 24 surrounds the flexible sheet 20.

The invention permits sonar receiving and transmitting arrays to be installed on hull surfaces with no serious disturbance to the hull plates and with relatively little added bulk. The arrays may be replaced and maintained more easily because they are more accessible.

The invention takes advantage of the progress that has been made in miniaturizing electronics and reducing the input noise of preamplifiers. Low-noise preamplifiers allow the use of smaller hydrophones. Small preamplifiers can be mounted adjacent to the hydrophones to minimize the length of the leads between them and the noise pickup in these leads.

It is easier to design high acoustic impedance into these arrays because frames, recessed holes and other special alterations are eliminated. High acoustic impedance improves end-fire response.

The small size of the acoustic and electronic elements makes the array more resistant to mechanical damage due to explosions and other sources. This also facilitates resistance to overvoltage caused by explosions and high-level acoustic sources and reduces the problems associated with sensitivity of the elements to mechanical vibration.

Figure 4:
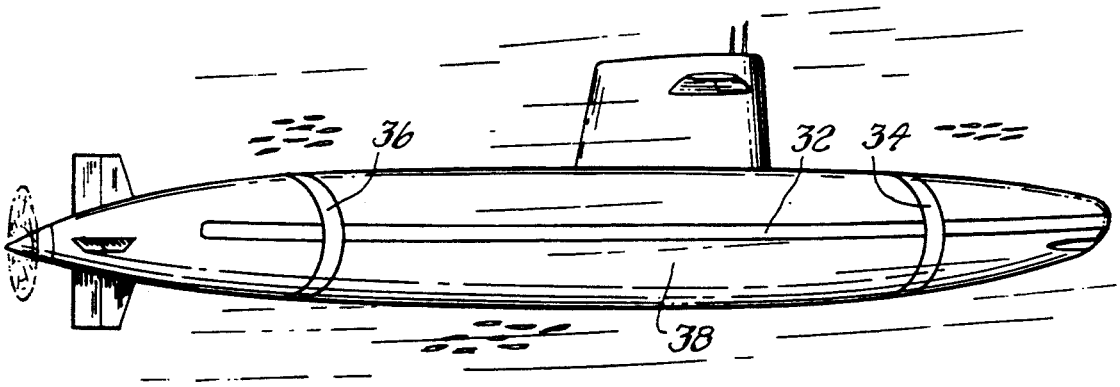
FIG. 4 is a schematic illustration of a number of flexible tapes arranged in different locations on the hull of a submarine.

In a more general sense, the invention is broader than transducer and preamplifier elements embedded in a pliable carrier. It includes any small elements, operated by electrical, acoustic, pressure, or other types of energy, which are small enough to be embedded in a thin flexible carrier. Thus, small pressure sensors might be embedded in a carrier tape, the tape then being affixed around the hull 38 of a submarine to provide pressure readings around the hull. This is indicated in FIG. 4 in which three strips of flexible tape are used, the first 32 extending longitudinally along the center of the hull and running around the nose of the submarine, the second 34 running transversely around the hull in the fore part of the submarine and the third 36 running traversely around the hull in the aft part of the submarine. Of course, other locations and arrangements are possible, as well as other shapes of the flexible tape.

The tapes shown in FIG. 4 could also, of course, have hydrophones and preamplifiers embedded therein.

We claim:

1. In combination with a ships underwater outside surface areas, a sonar conformal array comprising a carrier sheet of flexible material having acoustic properties substantially the same as those of seawater and substantially impermeable to seawater, and having embedded therein sonar transducers, solid state preamplifiers and interconnecting wiring which extend out the carrier sheet for connection elsewhere, and perimeter fairing means of flexible material joined to the carrier sheet and in combination with the carrier sheet having a flat surface cemented to the ship surfaces areas.

2. The combination defined in claim 1 further including a layer of vibration damping material in said carrier sheet between the transducers and the hull.

3. The combination defined in claim 2 further including an acoustic isolation layer between the transducers and the vibration damping material.

* * * * *